US007942693B2

(12) United States Patent
Dennes

(10) Patent No.: US 7,942,693 B2
(45) Date of Patent: May 17, 2011

(54) POWER OUTLET WITH CONDUCTIVE SOCKET CONTACTS COUPLED TO IDC CONTACTS COUPLED TO INSULATED CONDUCTORS DISPOSED IN CHANNELS

(75) Inventor: Wayne William Dennes, Wyoming (AU)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/598,262

(22) PCT Filed: Apr. 2, 2008

(86) PCT No.: PCT/AU2008/000470

§ 371 (c)(1),
(2), (4) Date: Apr. 1, 2010

(87) PCT Pub. No.: WO2008/134791

PCT Pub. Date: Nov. 13, 2008

(65) Prior Publication Data

US 2010/0197161 A1 Aug. 5, 2010

(30) Foreign Application Priority Data

May 4, 2007 (AU) ..... 2007902395

(51) Int. Cl.
*H01R 13/60* (2006.01)

(52) U.S. Cl. ..... 439/535

(58) Field of Classification Search ..... 439/76.1, 439/106, 535, 537; 174/53; 200/297
See application file for complete search history.

(56) References Cited

U.S. PATENT DOCUMENTS

D91,940 S 4/1934 Hollingsworth
D198,131 S 5/1964 Radtke
4,171,857 A 10/1979 Forberg et al.
4,333,700 A 6/1982 Pugh, III
4,405,187 A 9/1983 Muller et al.
4,452,502 A 6/1984 Forberg et al.
(Continued)

FOREIGN PATENT DOCUMENTS

AU 2001250509 B2 7/2001
(Continued)

OTHER PUBLICATIONS

Copending and commonly assigned U.S. Appl. No. 29/297,077, filed Nov. 2, 2007 to Wayne William Dennes titled "Power Outlet."

(Continued)

*Primary Examiner* — Chandrika Prasad
(74) *Attorney, Agent, or Firm* — Merchant & Gould P.C.

(57) ABSTRACT

A power outlet for effecting an electrical connection between an electric device and insulated conductors of an electric power cable, including a socket having apertures including electrically conductive socket contacts seated therein for effecting electrical connection to corresponding electrically conductive contacts of a plug of the electric device; a plurality of primary channels shaped to at least partially receive, and seat therein, respective lengthwise sections of the insulated conductors of the power cable; a plurality of insulation displacement contacts for making separate electrical connections to said insulated conductors, when received in said primary channels, under relative movement between the insulation displacement contacts and the insulated conductors; a connector, relatively movable with respect to the primary channels, for effecting said relative movement, wherein the insulation displacement contacts are electrically coupled to respective ones of said socket contacts; and said primary channels extend transversely to a lengthwise direction of extent of the power outlet.

25 Claims, 16 Drawing Sheets

U.S. PATENT DOCUMENTS

| | | | | |
|---|---|---|---|---|
| 4,500,746 | A | 2/1985 | Meehan | |
| 4,548,459 | A | 10/1985 | Mosser, III | |
| 4,614,576 | A | 9/1986 | Goldstein | |
| D299,822 | S | 2/1989 | Constable et al. | |
| 5,094,630 | A | 3/1992 | Jammet | |
| 5,100,332 | A | 3/1992 | Egawa | |
| D329,422 | S | 9/1992 | Fujiyoshi | |
| 5,228,872 | A | 7/1993 | Liu | |
| D347,622 | S | 6/1994 | Flasz | |
| 5,492,484 | A | 2/1996 | Archer | |
| 5,500,746 | A | 3/1996 | Aida | |
| D401,217 | S | 11/1998 | Wirth | |
| 5,919,060 | A | 7/1999 | Lee | |
| 5,947,761 | A | 9/1999 | Pepe | |
| 6,095,848 | A | 8/2000 | Munshi | |
| D454,543 | S | 3/2002 | Hu | |
| 6,406,323 | B2 | 6/2002 | Shan | |
| 6,488,539 | B1 * | 12/2002 | Turek et al. | 439/620.21 |
| 6,558,190 | B1 * | 5/2003 | Pierson, Jr. | 439/535 |
| 7,234,954 | B1 | 6/2007 | Srage et al. | |
| 7,329,140 | B2 | 2/2008 | O'Connell et al. | |
| 7,347,712 | B2 | 3/2008 | O'Connell et al. | |
| 7,435,119 | B2 | 10/2008 | Chang et al. | |
| D585,845 | S | 2/2009 | Dennes | |
| D587,203 | S | 2/2009 | Dennes et al. | |
| 7,510,429 | B1 * | 3/2009 | Savicki et al. | 439/535 |
| 2002/0013081 | A1 | 1/2002 | Shan | |
| 2004/0264076 | A1 | 12/2004 | Lee | |
| 2006/0030183 | A1 | 2/2006 | Yoshida et al. | |
| 2009/0258533 | A1 | 10/2009 | Dennes et al. | |

FOREIGN PATENT DOCUMENTS

| | | | |
|---|---|---|---|
| AU | 784652 | | 1/2003 |
| AU | 2005203509 | A1 | 2/2006 |
| AU | 2006241314 | | 12/2006 |
| EP | 0382482 | | 8/1990 |
| EP | 0382482 | | 5/1995 |
| EP | 0398560 | B1 | 8/1995 |
| GB | 2 165 101 | | 4/1986 |
| GB | 2 292 269 | | 2/1996 |
| WO | WO 01/50548 | A1 | 7/2001 |

OTHER PUBLICATIONS

Copending and commonly assigned U.S. Appl. No. 29/297,082, filed Nov. 2, 2007 to Wayne William Dennes titled "Power Outlet."

Australian dual switched power point, last modified May 23, 2006, [online], [retrieved Oct. 23, 2008]. Retrieved from Internet, <URL:http://en.wikipedia.org/wiki/Image:Australian_dual_switched_power_point.jpg>.

* cited by examiner

POWER OUTLET WITH CONDUCTIVE SOCKET CONTACTS COUPLED TO IDC CONTACTS COUPLED TO INSULATED CONDUCTORS DISPOSED IN CHANNELS

This application is a National Stage Application of PCT/AU2008/000470, filed 2 Apr. 2008, which claims benefit of Serial No. 2007902395, filed 4 May 2007 in Australia and which applications are incorporated herein by reference. To the extent appropriate, a claim of priority is made to each of the above disclosed applications.

TECHNICAL FIELD OF THE INVENTION

The present invention relates to a power outlet.

BACKGROUND OF THE INVENTION

Power outlets are typically used to electrically couple electric devices to the insulated conductors of a power cable. They have previously employed screw contacts to effect electrical connections to the insulated conductors of the power cable. The following steps may be performed to electrically connect a power outlet to the insulated conductors of a power cable:

1. Stripping of insulation from end sections of the conductors;
2. Inserting stripped end sections of the conductors into openings of respective connectors of the power outlet; and
3. Fastening the conductors to the connectors by tightening the screws.

Performing the above-described steps to install a power outlet may be labour intensive and inconvenient.

An electrical connection may otherwise be effected using an insulation displacement contact that includes a contact element which is bifurcated so as to define two opposed contact portions separated by a slot into which an insulated conductor may be pressed so that edges of the contact portions engage and displace the insulation and such that the contact portions resiliently engage and make electrical connection with the conductor of the wire. Such a contact is described in, for example U.S. Pat. Nos. 4,452,502 and 4,405,187. While, in some cases, making electrical connection to a single wire in the above way is all that is necessary, occasions arise where it would be useful to make connection to more than one wire by inserting the wires, one after the other, into the slot. With a carefully designed contact it may be possible to make connections in this way to two wires, but it is difficult to make effective connections to several wires. This arises because, during the process of introducing a first wire into the slot, the contact portions are resiliently deformed, such that the gap between them is to some extent increased. The resultant increase in slot width may still permit an adequate connection to be made to a second wire when inserted into the slot. However, the increased slot width may even be such that the contact portions fail to properly pierce the insulation, or it may otherwise leave the second wire unreliably gripped. This problem becomes worse as more wires are inserted.

The above problem is alleviated in Krone LSA-PLUS connectors by arranging that the contact portions are torsionally twisted during insertion of the wires. That is, the wires are introduced into the slot with their directions of extent arranged at an angle of about 45 degrees to the side to side direction of the slot, so that insertion of the wires tends to deflect contacting edges of the respective contact portions outwardly away from each other, in opposite directions relative to the general plane of the contact. In that case, it is possible to achieve good connection to two wires but even in this construction more than two wires may not be adequately accommodated. U.S. Pat. No. 5,492,484 also describes a particular form of contact that is indicated as being able to terminate more than a single conductor. This is however complicated in form.

It is generally desirable to provide a power outlet that can effect quick and easy electrical connection to the insulated conductors of a power cable.

It is generally desirable to overcome or ameliorate one or more of the above mentioned difficulties, or at least provide a useful alternative.

SUMMARY OF THE INVENTION

In accordance with the present invention, there is provided a power outlet for effecting an electrical connection between an electric device and insulated conductors of an electric power cable including:

(a) a socket having apertures including electrically conductive socket contacts seated therein for effecting electrical connection to corresponding electrically conductive contacts of a plug of the electric device;

(b) a plurality of primary channels shaped to at least partially receive, and seat therein, respective lengthwise sections of the insulated conductors of the power cable;

(c) a plurality of insulation displacement contacts for making separate electrical connections to said insulated conductors, when received in said primary channels, under relative movement between the insulation displacement contacts and the insulated conductors;

(d) a connector, relatively movable with respect to the primary channels, for effecting said relative movement, wherein the insulation displacement contacts are electrically coupled to respective ones of said socket contacts, and said primary channels extend transversely to a lengthwise direction of extent of the power outlet.

Advantageously, the above described power outlet can effect quick and easy electrical connection to the insulated conductors of a power cable.

BRIEF DESCRIPTION OF THE DRAWINGS

Preferred embodiments of the present invention are hereafter described, by way of non-limiting example only, with reference to the accompanying drawing in which.

DETAILED DESCRIPTION OF PREFERRED EMBODIMENTS OF THE INVENTION

Figure 1:
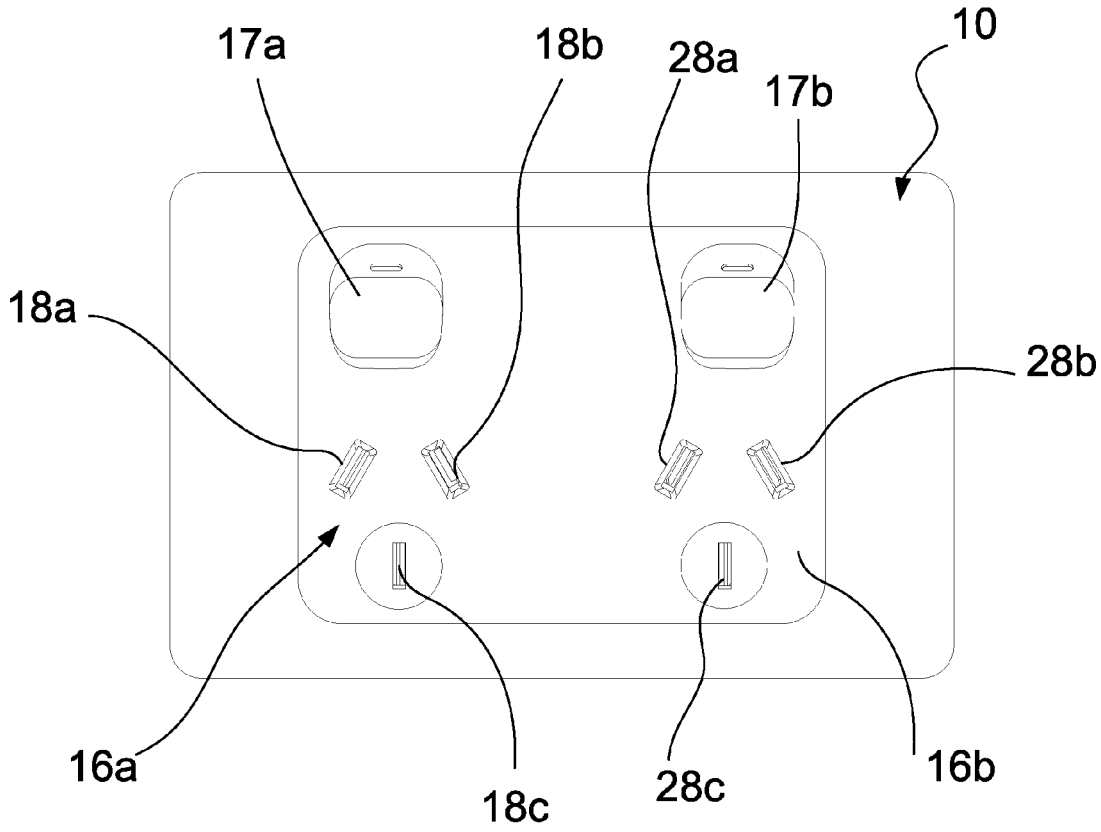
FIG. 1 is a diagrammatic illustration of a front view of a power outlet.
Figure 2:
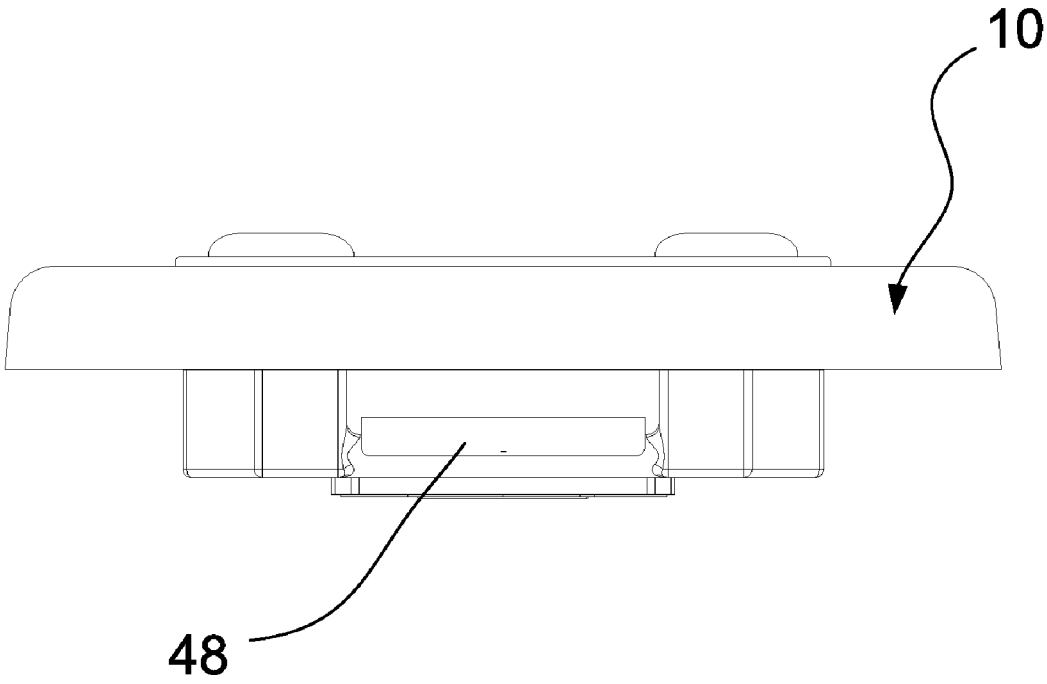
FIG. 2 is a diagrammatic illustration of a top view of the power outlet shown in FIG. 1.
Figure 3:
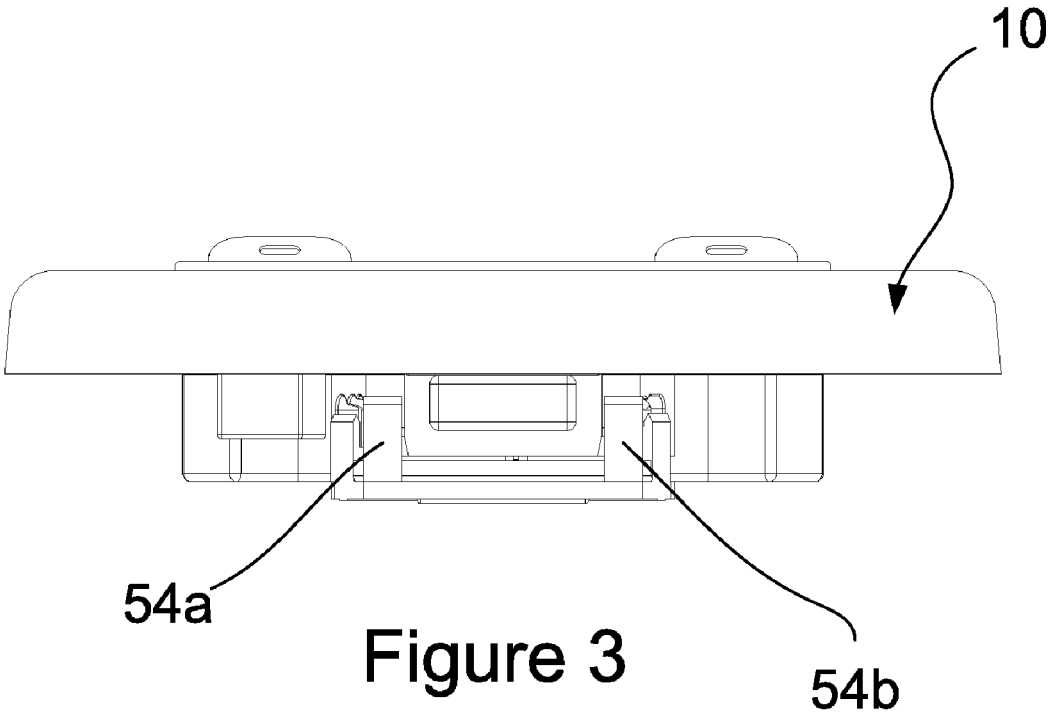
FIG. 3 is a diagrammatic illustration of a bottom view of the power outlet shown in FIG. 1.
Figure 4:
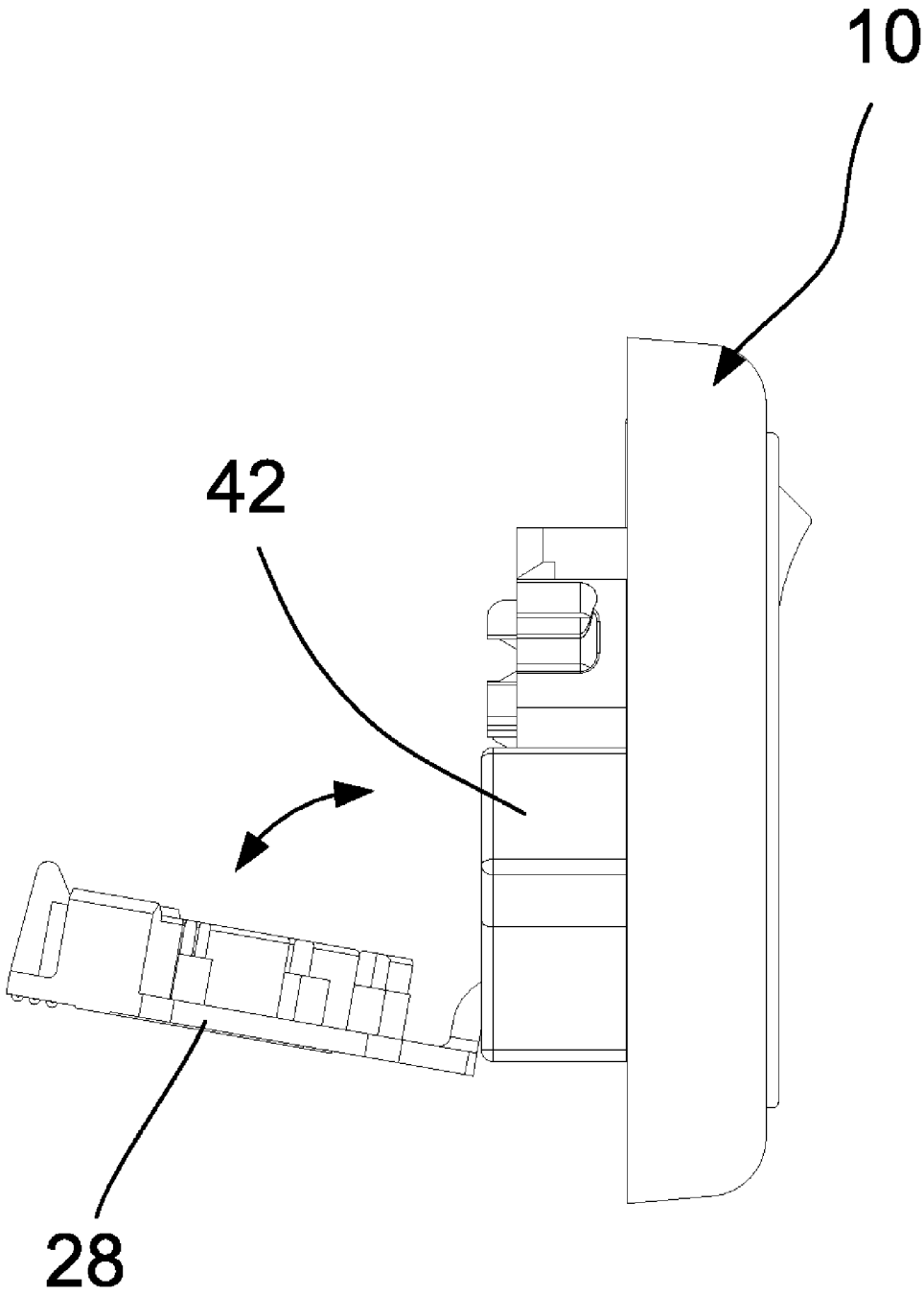
FIG. 4 is a diagrammatic illustration of a side view of the power outlet shown in FIG. 1.

The power outlet 10 shown in FIGS. 1 to 5 is used to effect electrical connection between an electric device (not shown) and the insulated conductors 12 of an electric power cable 14 in the manner shown in FIGS. 6 to 11. The power outlet 10 can, advantageously, effect electrical connections with the insulated conductors 12 of the power cable 14 without the need for an installer to screw the conductors into position. The power outlet 10 can, advantageously, be utilised to effect connection to the insulated conductors 12 of the power cable 14 quickly and easily.

The outlet 10 includes a socket 16*a* having apertures 18*a*, 18*b*, 18*c* including electrically conductive socket contacts 20*a*, 20*b*, 20*c*, seated therein, arranged in the manner shown in FIGS. 13 to 17. The socket contacts 20*a*, 20*b*, 20*c* are shaped to receive, and form electrical connections with, corresponding electrically conductive contacts of the plug (not shown) of the electric device. As particularly shown in FIG. 5, the outlet 10 includes primary channels 22*a*, 22*b*, 22*c* shaped to at least partially receive, and seat therein, respective lengthwise sections 24*a*, 24*b*, 24*c* of the insulated conductors 12 of the power cable 14. The outlet 10 includes a plurality of insulation displacement contacts 26*a*, 26*b*, 26*c* for making separate electrical connections to the insulated conductors 12, when received in the primary channels 22*a*, 22*b*, 22*c*, under relative movement between the insulation displacement contacts 26*a*, 26*b*, 26*c* and the insulated conductors 12. As particularly shown in FIG. 4, the outlet 10 also includes a connector 28, relatively movable with respect to the primary channels 22*a*, 22*b*, 22*c*, for effecting the relative movement between the insulation displacement contacts 26*a*, 26*b*, 26*c* and the insulated conductors 12. The insulation displacement contacts 26*a*, 26*b*, 26*c* are electrically coupled to respective ones of the socket contacts 20*a*, 20*b*, 20*c*. The primary channels 22*a*, 22*b*, 22*c* extend transversely to a lengthwise direction of extent "X" of the power outlet 10.

The outlet 10 also includes another socket 16*b* having apertures 28*a*, 28*b*, 28*c* including electrically conductive socket contacts 30*a*, 30*b*, 30*c*, seated therein, arranged in the manner shown in FIGS. 13 to 17. The socket contacts 30*a*, 30*b*, 30*c* are shaped to receive, and form electrical connections with, corresponding electrically conductive contacts of a plug (not shown) of another electric device connected to the socket 16*b*. The insulation displacement contacts 26*a*, 26*b*, 26*c* are electrically coupled to respective ones of the socket contacts 30*a*, 30*b*, 30*c*.

As particularly shown in FIGS. 13 to 17, the socket contacts 20*a* and 30*a* of the sockets 16*a* and 16*b* are shaped for electrical connection to corresponding active electrical contacts of a plug of an electrical device (not shown). The socket contacts 20*a* and 30*a* are electrically coupled to an electrically conductive spanning contact 32*a* by electrically conductive clips 34*a* and 34*b*. The insulation displacement contact 26*a* includes a lateral bifurcated contact 36*a* electrically coupled to the spanning contact 32*a*. The spanning contact 32*a* is electrically connected to the insulation displacement contact 26*a* when inserted between the bifurcated arms of the contact 36*a*. The bifurcated arms of the contact 36*a* resiliently bear against the spanning contact 32*a* and thereby secure the contacts 32*a*, 36*a* in electrical communication.

The active socket contacts 20*a*, 30*a* can be independently electrically isolated from the corresponding insulation displacement contact 26*a* by corresponding switches 17*a*, 17*b*. The switches operate in a conventional manner and are not described here in further detail.

The socket contacts 20*b* and 30*b* of the sockets 16*a* and 16*b* are shaped for electrical connection to corresponding neutral electrical contacts of a plug of an electrical device (not shown). The socket contacts 20*b* and 30*b* are electrically coupled to an electrically conductive spanning contact 32*b*. The insulation displacement contact 26*b* includes a longitudinal bifurcated contact 36*b* electrically coupled to the spanning contact 32*b*. The spanning contact 32*b* is electrically connected to the insulation displacement contact 26*b* when inserted between the bifurcated arms of the contact 36*b*. The bifurcated arms of the contact 36*b* resiliently bear against the spanning contact 32*b* and thereby secure the contacts 32*b*, 36*b* in electrical communication.

The socket contacts 20*c* and 30*c* of the sockets 16*a* and 16*b* are shaped for electrical connection to corresponding earth electrical contacts of a plug of an electrical device (not shown). The socket contacts 20*c* and 30*c* are electrically coupled to an electrically conductive spanning contact 32*c*. The insulation displacement contact 26*c* includes a lateral bifurcated contact 36*c* electrically coupled to the spanning contact 32*c*. The spanning contact 32*c* is electrically connected to the insulation displacement contact 26*c* when inserted between the bifurcated arms of the contact 36*c*. The bifurcated arms of the contact 36*c* resiliently bear against the spanning contact 32*c* and thereby secure the contacts 32*c*, 36*c* in electrical communication.

The insulation displacement contacts 26*a*, 26*b*, 26*c* are preferably electrically connected to respective spanning contacts 32*a*, 32*b*, 32*c* by bifurcated contacts 36*a*, 36*b*, 36. However, they could, alternatively, be electrically coupled to the spanning contacts 32*a*, 32*b*, 32*c* by any other suitable means.

Figure 5:
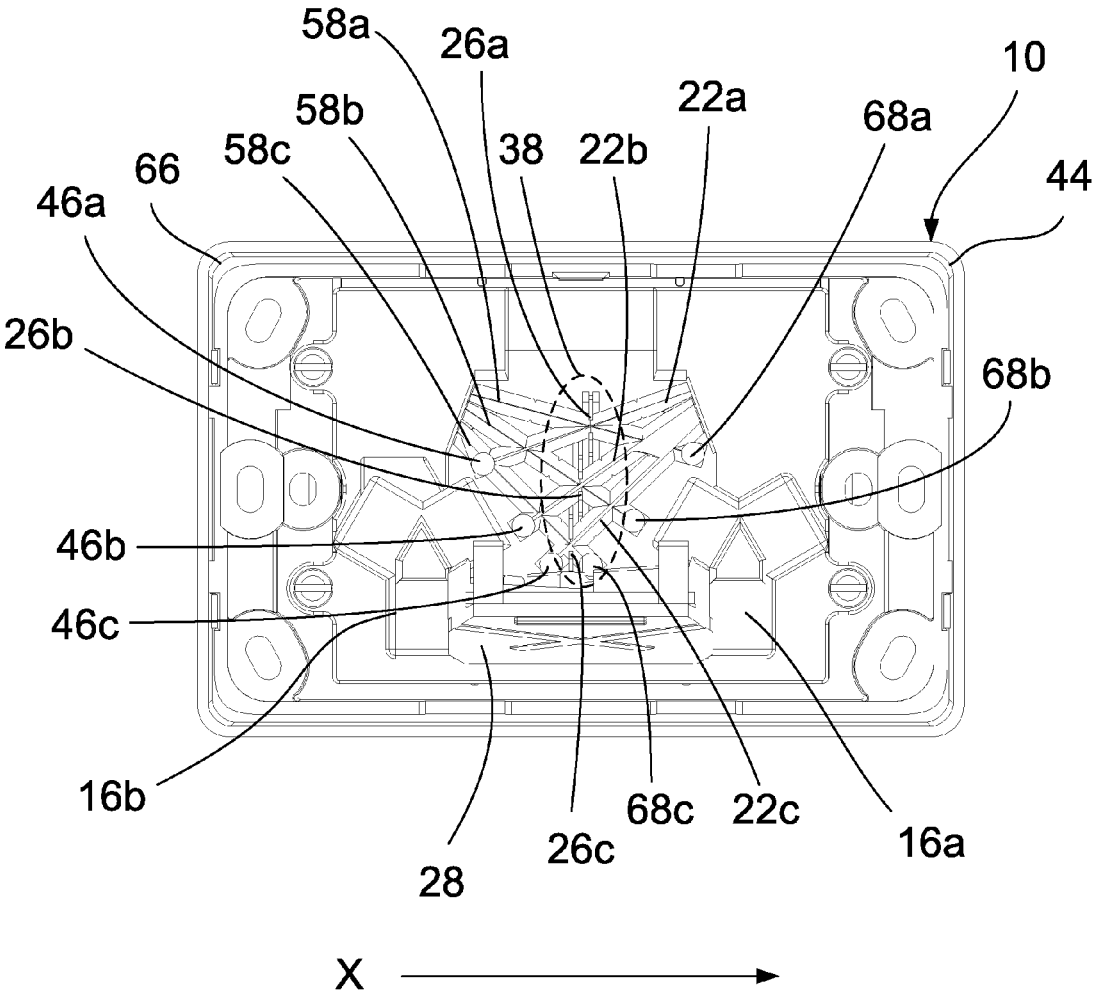
FIG. 5 is a diagrammatic illustration of a back view of the power outlet shown in FIG. 1.

As particularly shown in FIG. 5, the insulation displacement contacts 26*a*, 26*b*, 26*c* are stacked vertically, in respective primary channels 22*a*, 22*b*, 22*c*, in a central section 38 of the back side 40 of the outlet 10. Side to side directions of the openings of the contacts 26*a*, 26*b*, 26*c* are generally parallel. In other words, slots defined by the bifurcated arms of the contacts 26*a*, 26*b*, 26*c* open in a generally common direction "X".

Figure 7:
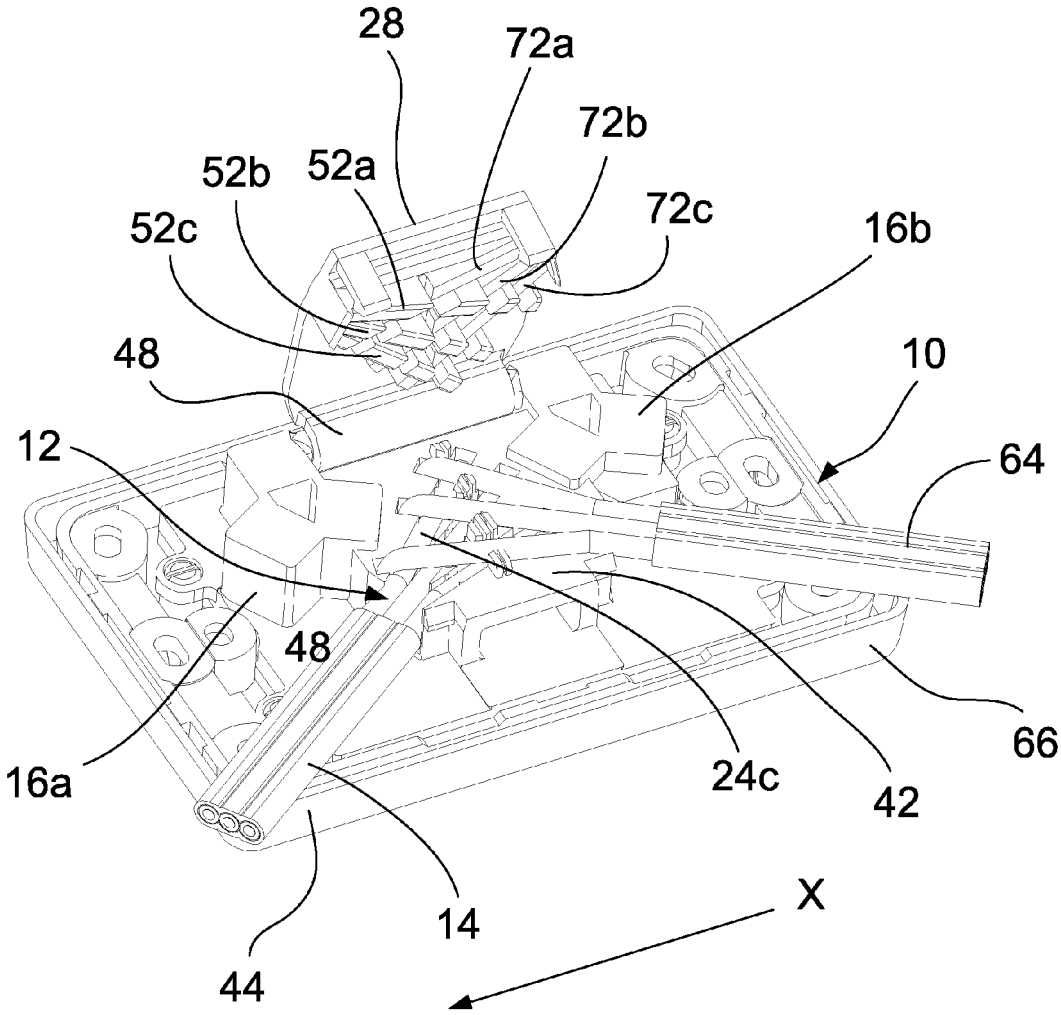
FIG. 7 is a diagrammatic illustration of a perspective view of the power outlet shown in FIG. 6.
Figure 8:
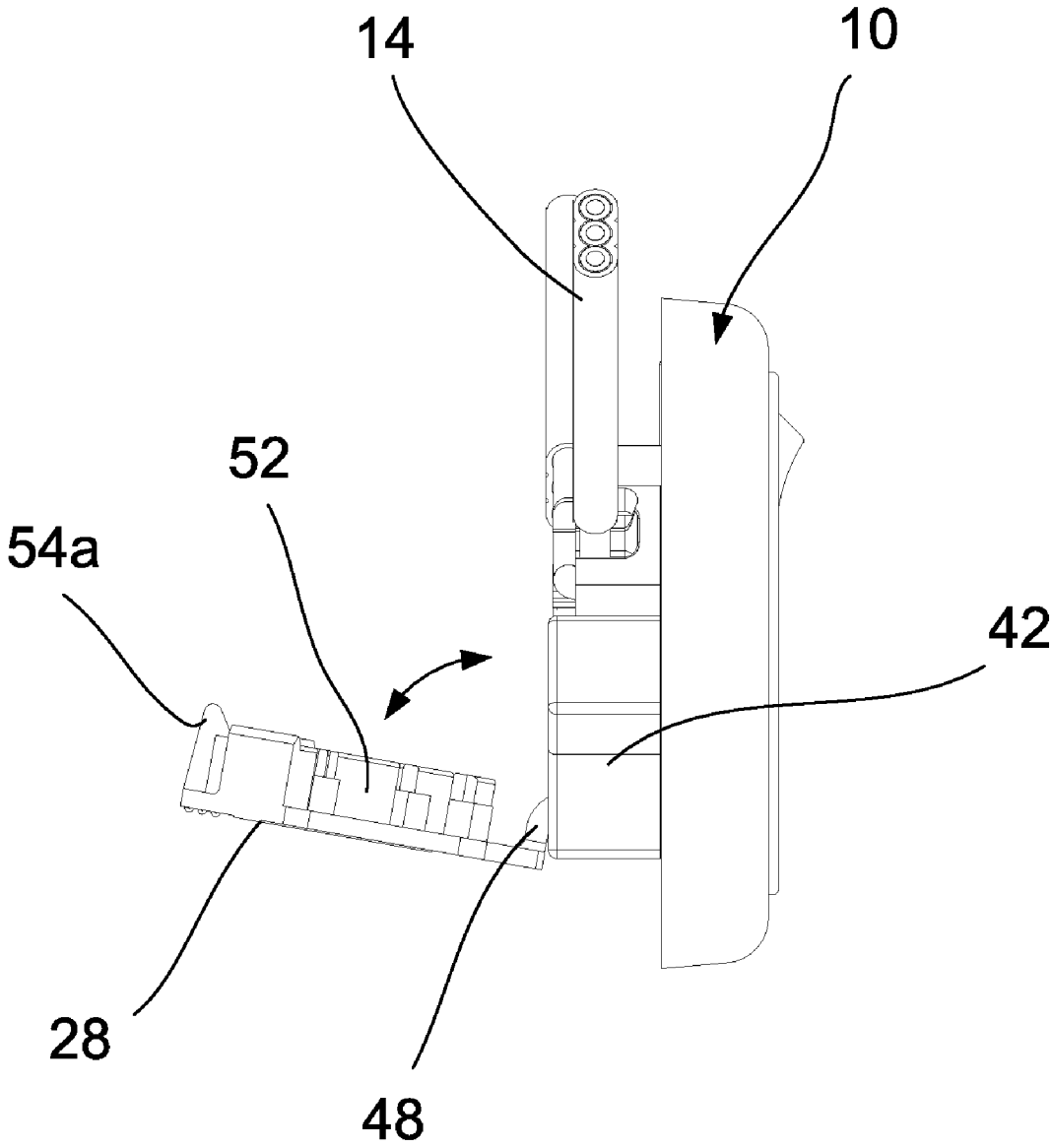
FIG. 8 is a diagrammatic illustration of a side view of the power outlet shown in FIG. 6.

As particularly shown in FIG. 7, the primary channels 22*a*, 22*b*, 22*c* are formed in a channel plate 42 coupled to the back side 40 of the power outlet 10. The channel plate 42 is centrally disposed on the back side 40 of the outlet 10. The channels 26*a*, 26*b*, 26*c* extend through respective insulation displacement contacts 26*a*, 26*b*, 26*c* and converge at a common point towards the corner 44 of the back side 40 of the connector 10. Thus, the insulated conductors 24*a*, 24*b*, 24*c* fan out from the cable 14 when they are seated in corresponding channels 22*a*, 22*b*, 22*c*. The cable 14 thereby extends past the corner 44 of the back side 40 of the outlet 10 when the insulated conductors 24*a*, 24*b*, 24*c* are seated in their respective channels 22*a*, 22*b*, 22*c*. As particularly shown in FIG. 5, the channel plate 42 includes termination wells 46*a*, 46*b*, 46*c* located at terminal ends of the channels 24*a*, 24*b*, 24*c*. The termination wells 46*a*, 46*b*, 46*c* are shaped to receive and electrically isolate terminal ends of the insulated conductors 24*a*, 24*b*, 24*c*.

The connector 28 is formed of an electrically insulative material and has an elongate and somewhat planar shape. The connector 28 is shaped to fit over the channel plate 42 so as to close the channels 22*a*, 22*b*, 22*c*. A restraining means, in the form of a hinge 48, is provided to for pivotally coupling the connector 28 to the channel plate 42. The hinge 48 rotates about an axis generally parallel to, and to one side of, the lengthwise direction of extent of the outlet 10. The connector is adapted to rotate about the hinge 48 between the open position shown in FIGS. 5 to 8 and the closed position shown in FIGS. 10 and 11.

Figure 12:
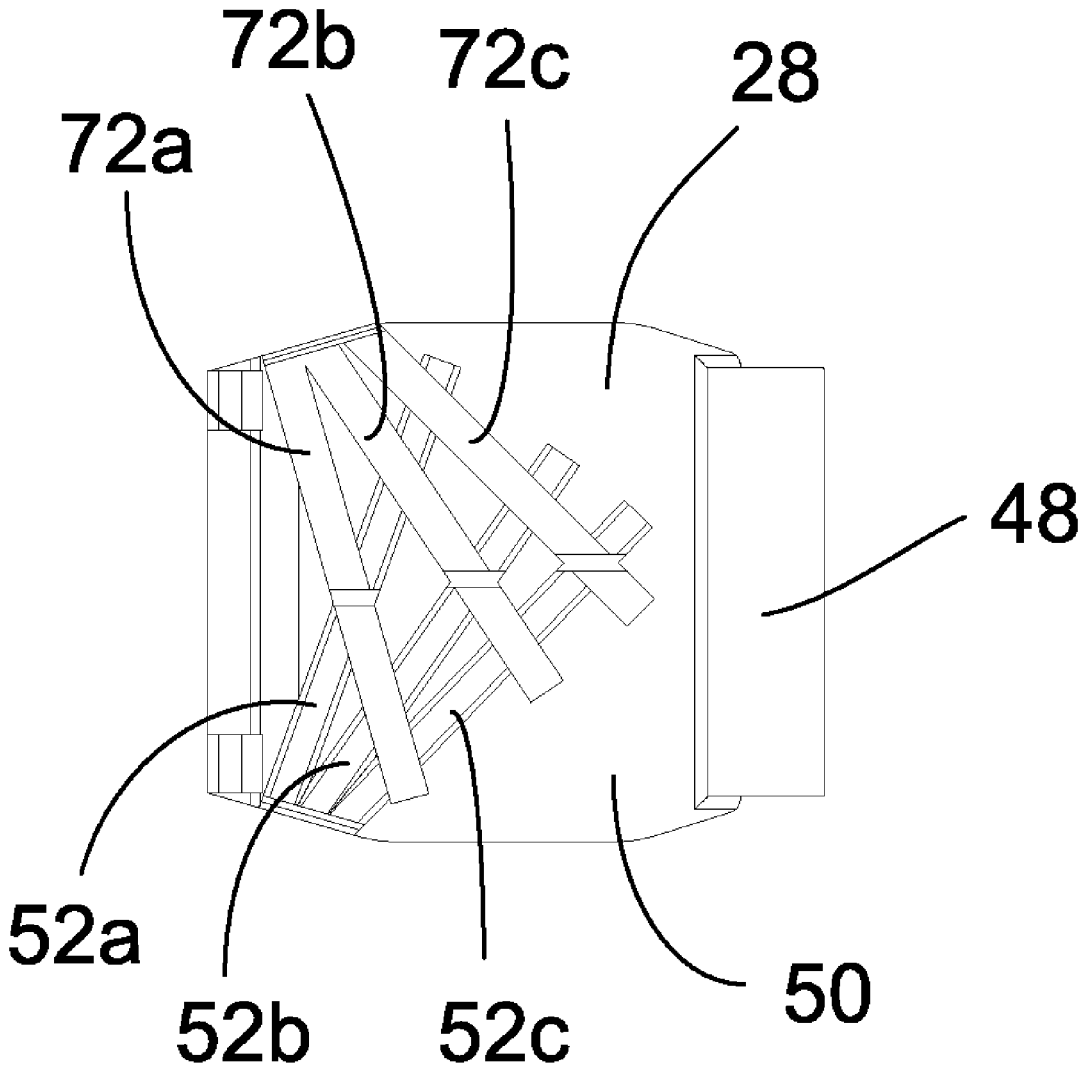
FIG. 12 is a diagrammatic illustration of a connector of the power outlet shown in FIG. 1.
Figure 13:
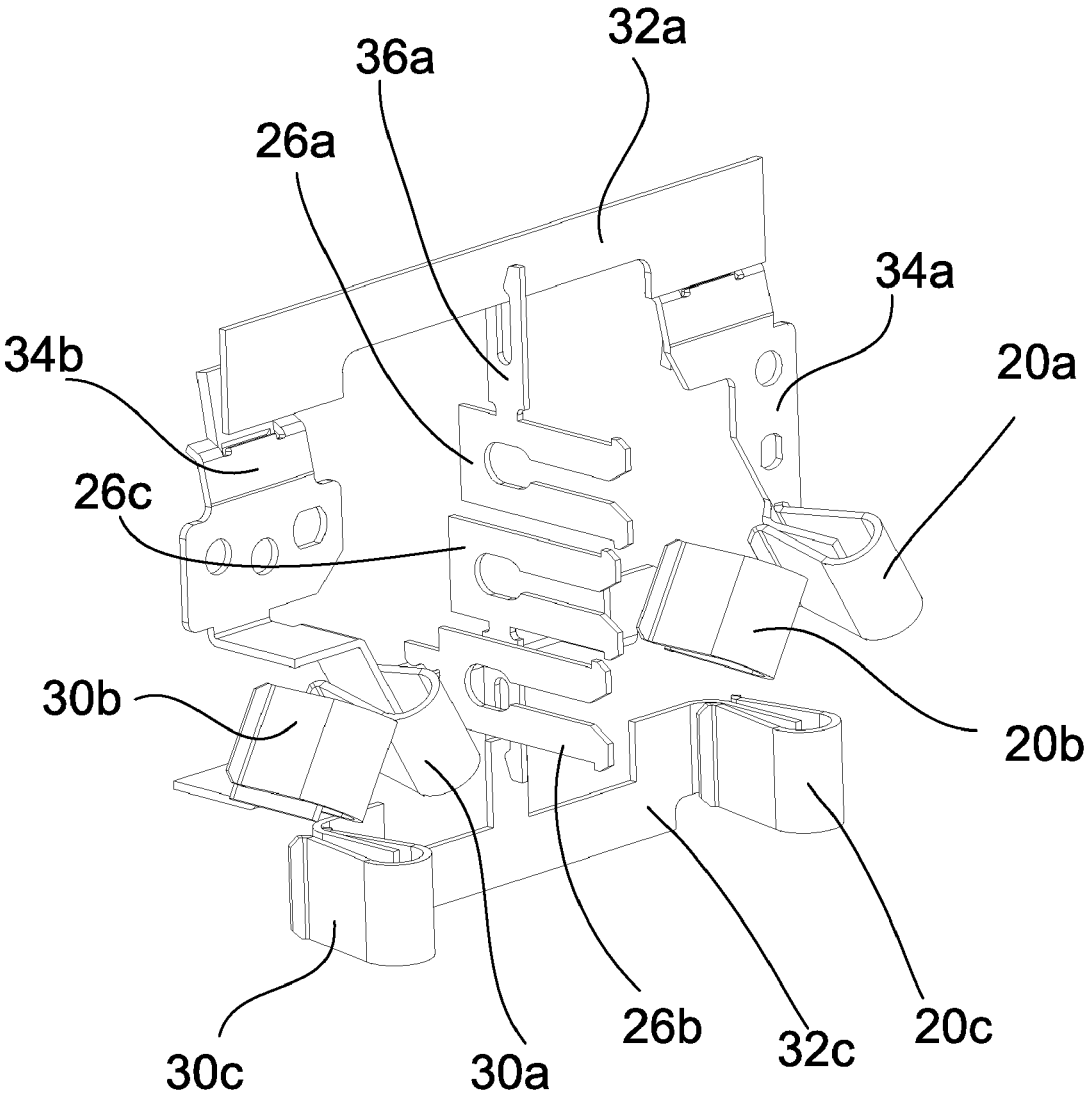
FIG. 13 is a diagrammatic illustration of a perspective view of electrically conductive contacts of the power outlet shown in FIG. 1.
Figure 14:
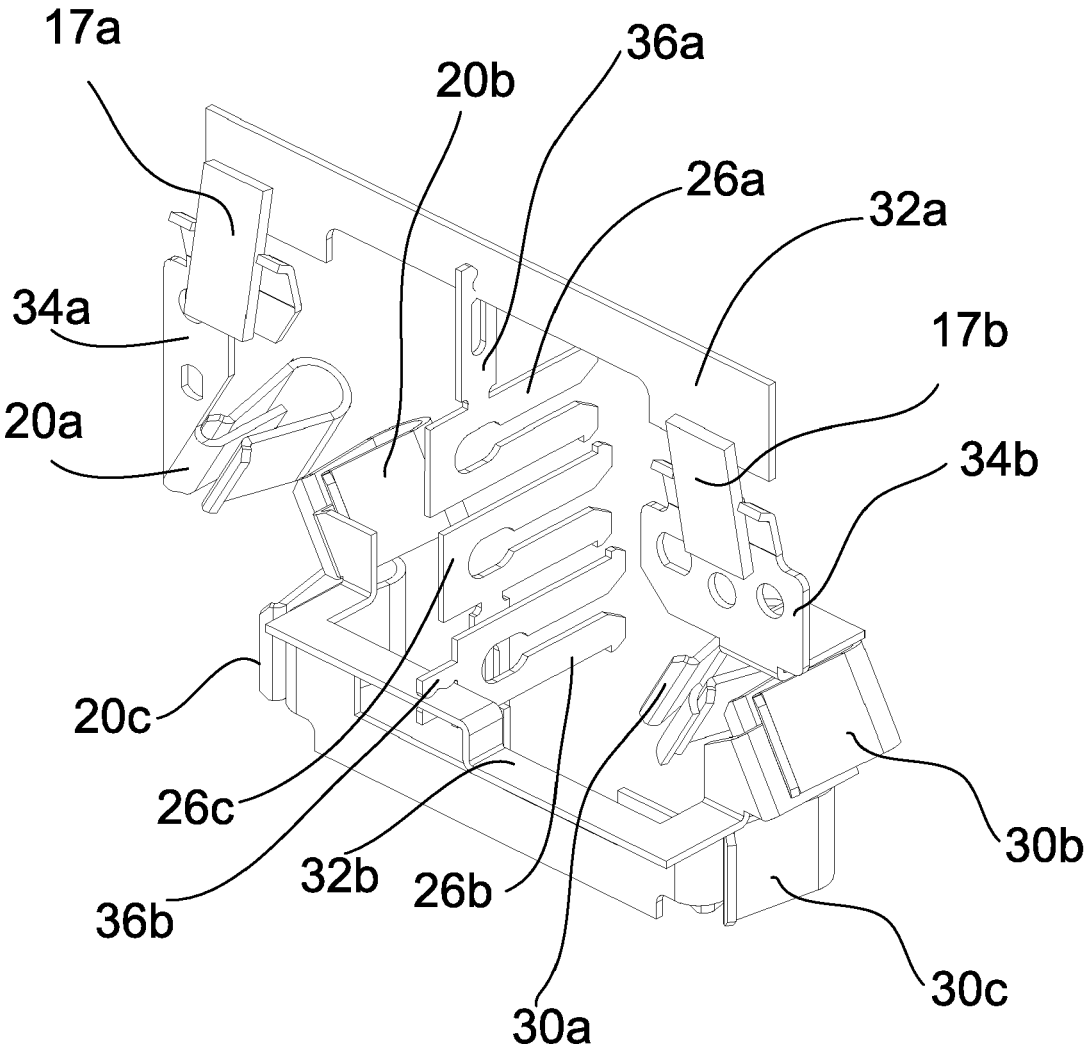
FIG. 14 is a diagrammatic illustration of another perspective view of the electrically conductive contacts shown in FIG. 13.
Figure 15:
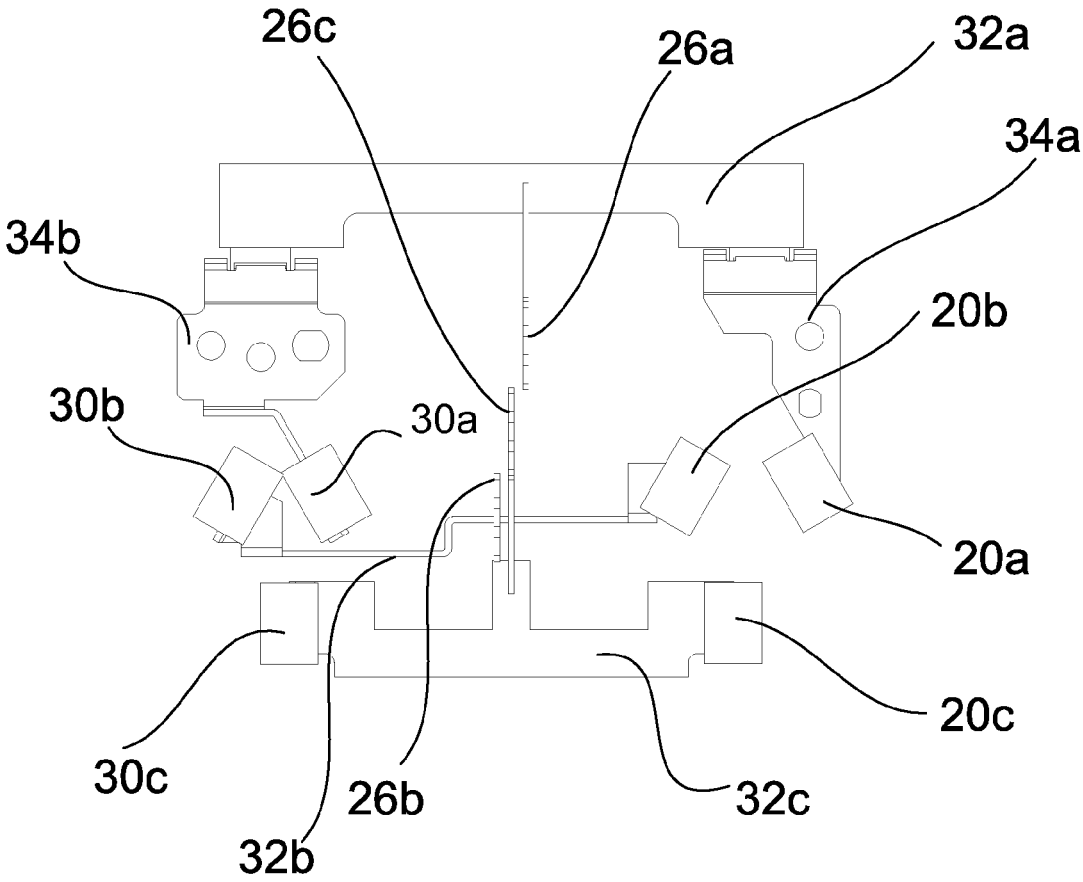
FIG. 15 is a diagrammatic illustration of a back view of the electrically conductive contacts shown in FIG. 13.
Figure 16:
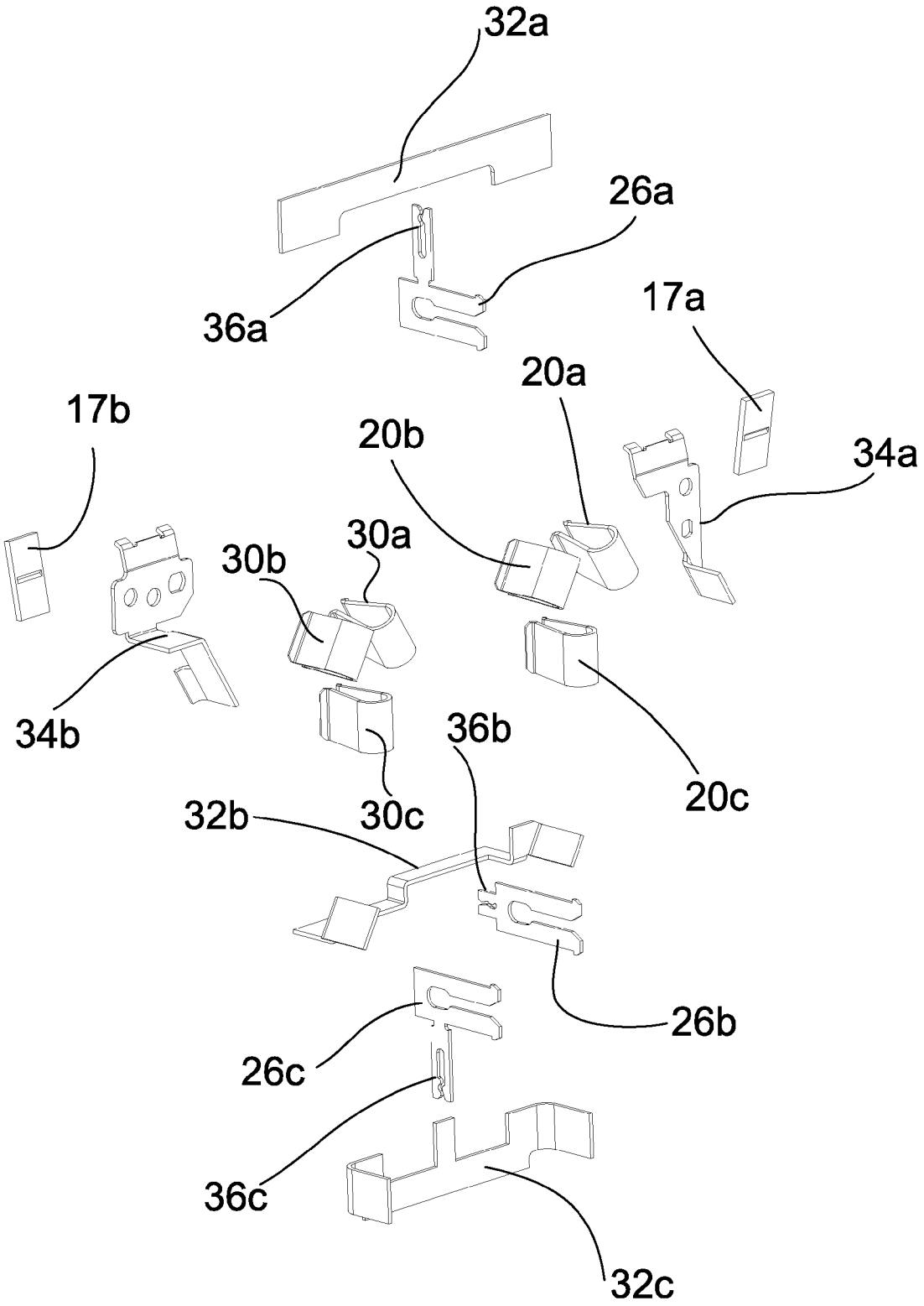
FIG. 16 is a diagrammatic illustration of an exploded view of the electrically conductive contacts shown in FIG. 13.
Figure 17:
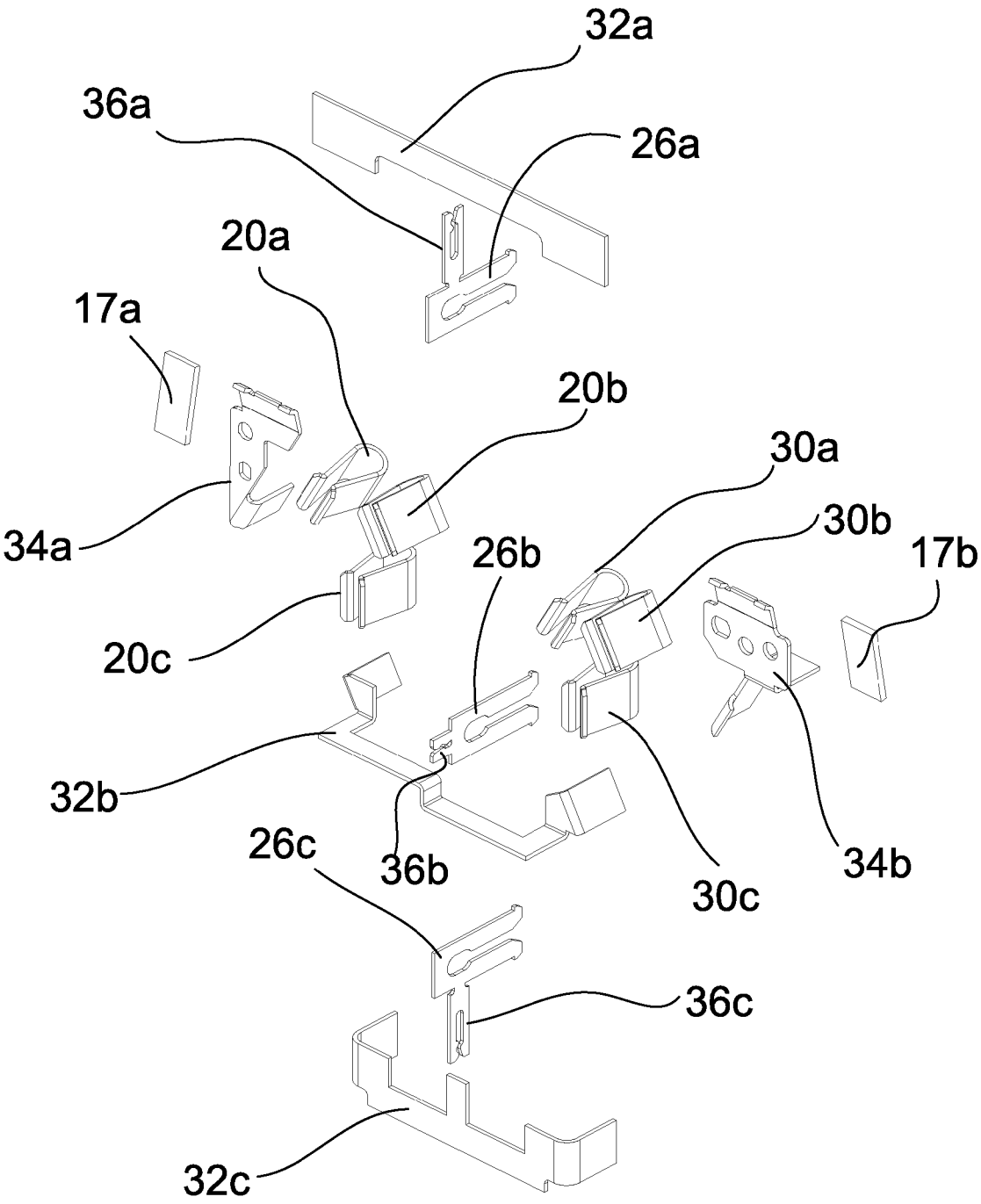
FIG. 17 is a diagrammatic illustration of another exploded view of the electrically conductive contacts shown in FIG. 13.

As particularly shown in FIGS. 7 and 12, an inner side 50 of the connector 28 includes a plurality of projections 52*a*, 52*b*, 52*c* that extend along corresponding channels 22*a*, 22*b*, 22*c* of the channel plate 48 when the connector 28 is arranged in the closed position. When so arranged, the projections 52*a*, 52*b*, 52*c* are brought to positions where they are located over, and at least partially within, respective ones of the channels 22*a*, 22*b*, 22*c*. When the connector 28 is moved to the closed position shown in FIG. 10, the projections 52*a*, 52*b*, 52*c* are likewise located in respective ones of the channels 22*a*, 22*b*, 22*c*.

The following steps are performed to effect electrical connection between the power outlet 10 and the insulated conductors 12 of the cable 14:

1. The outlet 10 is arranged in the open position shown in FIG. 5, where the connector 28 is swung clear of the channel plate 42;
2. The cable 14, having a portion of its outer cover removed, is laid diagonally across the back side 40 of the outlet 10;
3. The insulated conductors 24*a*, 24*b*, 24*c* are positioned so as to extend over respective channels 22*a*, 22*b*, 22*c;*
4. The insulated conductors 24*a*, 24*b*, 24*c* are then lightly pressed into the channels 22*a*, 22*b*, 22*c;*
5. The connector 28 is swung about the axis of the hinge 48 so that it overlies the channel plate 48 and so that the projections 52*a*, 52*b*, 52*c* engage the insulated conductors 24*a*, 24*b*, 24*c* and press them into their respective channels 22*a*, 22*b*, 22*c*; and
6. Connector 28 is then pressed fully down so that projections 52*a*, 52*b*, 52*c* firmly engaged the insulated conductors 24*a*, 24*b*, 24*c* and force them to form electrical connections with corresponding insulation displacement contacts 26*a*, 26*b*, 26*c*. Locking projections 54*a*, 54*b* of the connector 28 engage corresponding locking projections 56*a*, 56*b* of the back side 40 of the outlet 10. The connector 28 is thereby secured to the channel plate 42.

Following the above steps, the power outlet 10 need only be terminated once to provide a double socket 16*a*, 16*b* outlet. As will be observed particularly from FIG. 9, by rotating the connector 28 about the hinge 48, the projections 52*a*, 52*b*, 52*c* sequentially engage respective ones of the insulated conductors 24*a*, 24*b*, 24*c*. That is to say, at first the projection 52*c* is brought into contact with the wire 24*c* located in the channel 22*c*; then the projection 52*b* is brought in to contact with the wire 24*b* located in the channel 22*b*; and, lastly, the projection 52*a* is brought into contact with the wire 24*a* located in the channel 22*a*. As a result, the wires are forced into the insulation displacement contacts 26*c*, 26*b*, 26*a* sequentially. The forces which need to be applied to effect the making of electrical connection to the insulation displacement contacts 26*c*, 26*b*, 26*a* are also sequentially applied. By this, at any one time, it is sufficient to generally apply a force which would be enough to force only one wire at a time into position.

As above mentioned, the insulation displacement contacts 26*a*, 26*b*, 26*c* are centrally disposed. As such, the force applied to close the connector 28 can be concentrated in one spot. Advantageously, the centrally disposed insulation displacement contacts reduce the force needed to close the connector 28.

Figure 9:
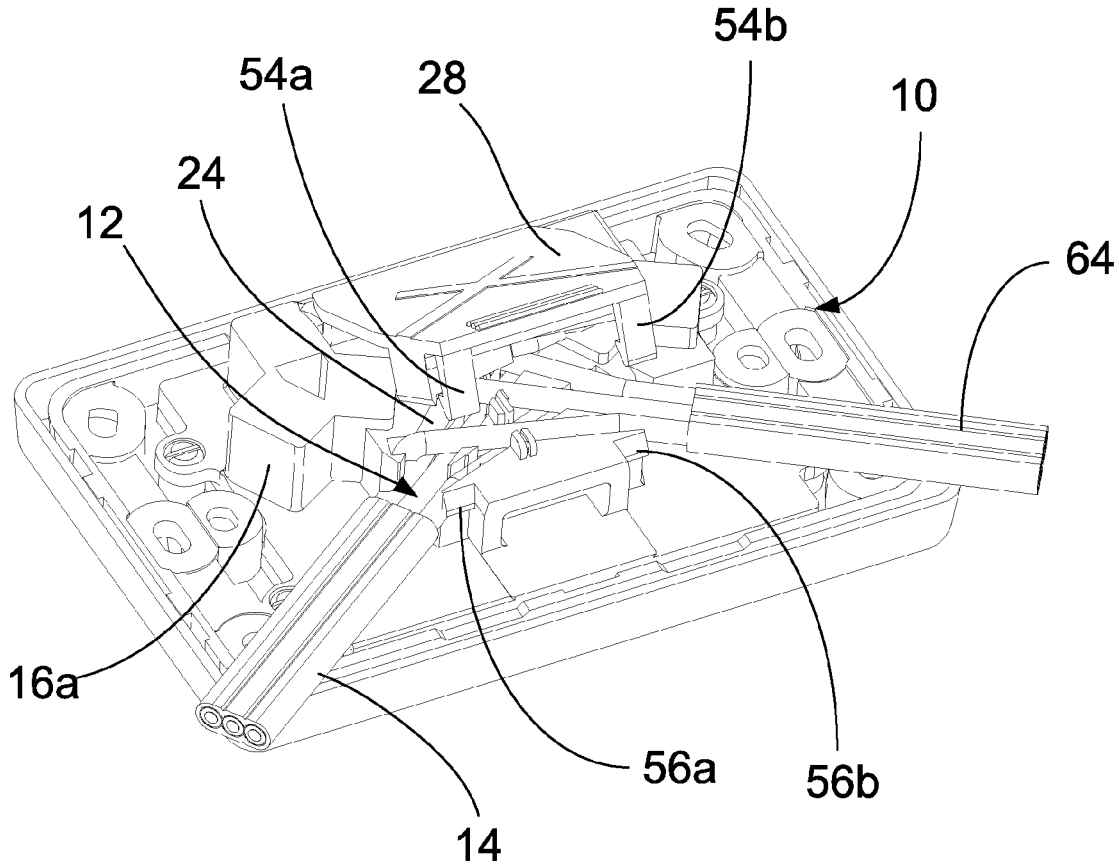
FIG. 9 is a diagrammatic illustration of a perspective view of the power outlet shown in FIG. 6 arranged in another condition of use.
Figure 10:
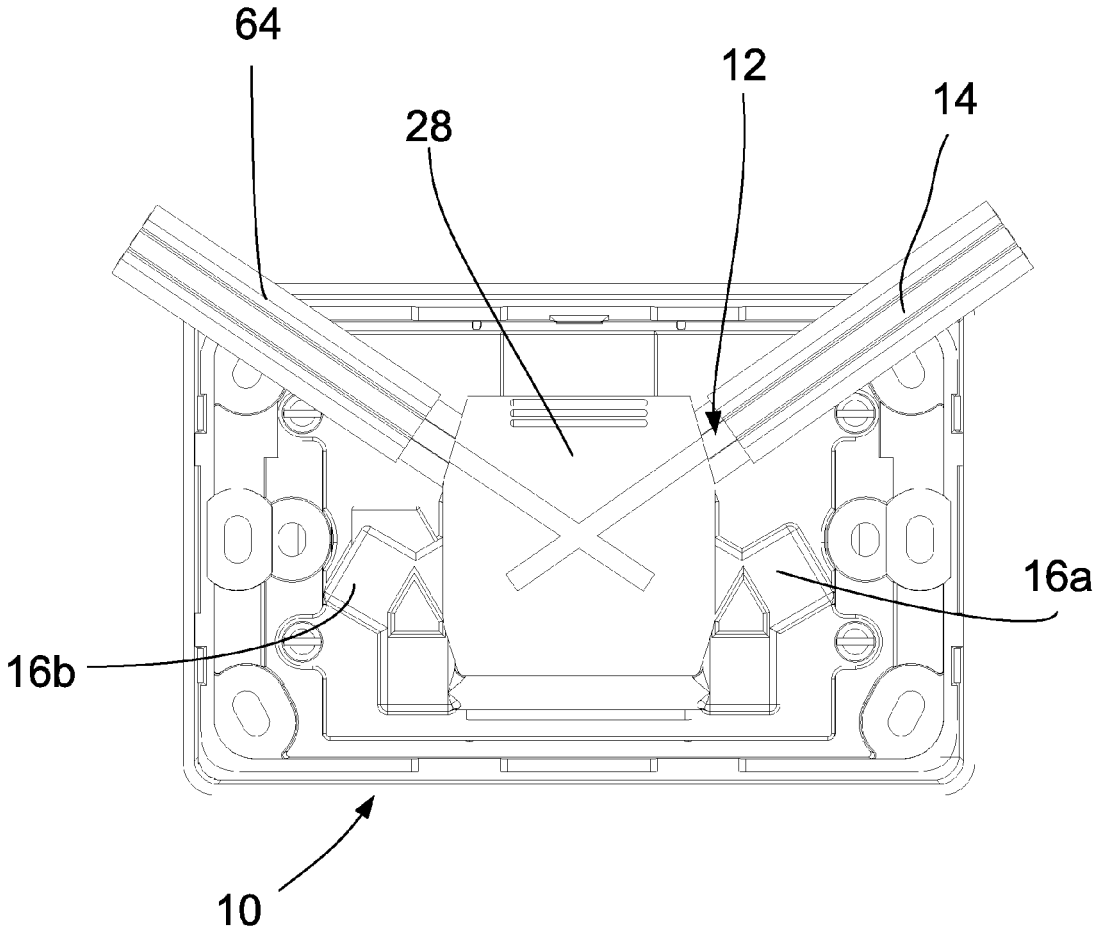
FIG. 10 is a diagrammatic illustration of a back view of the power outlet shown in FIG. 6 arranged in yet another condition of use.
Figure 11:
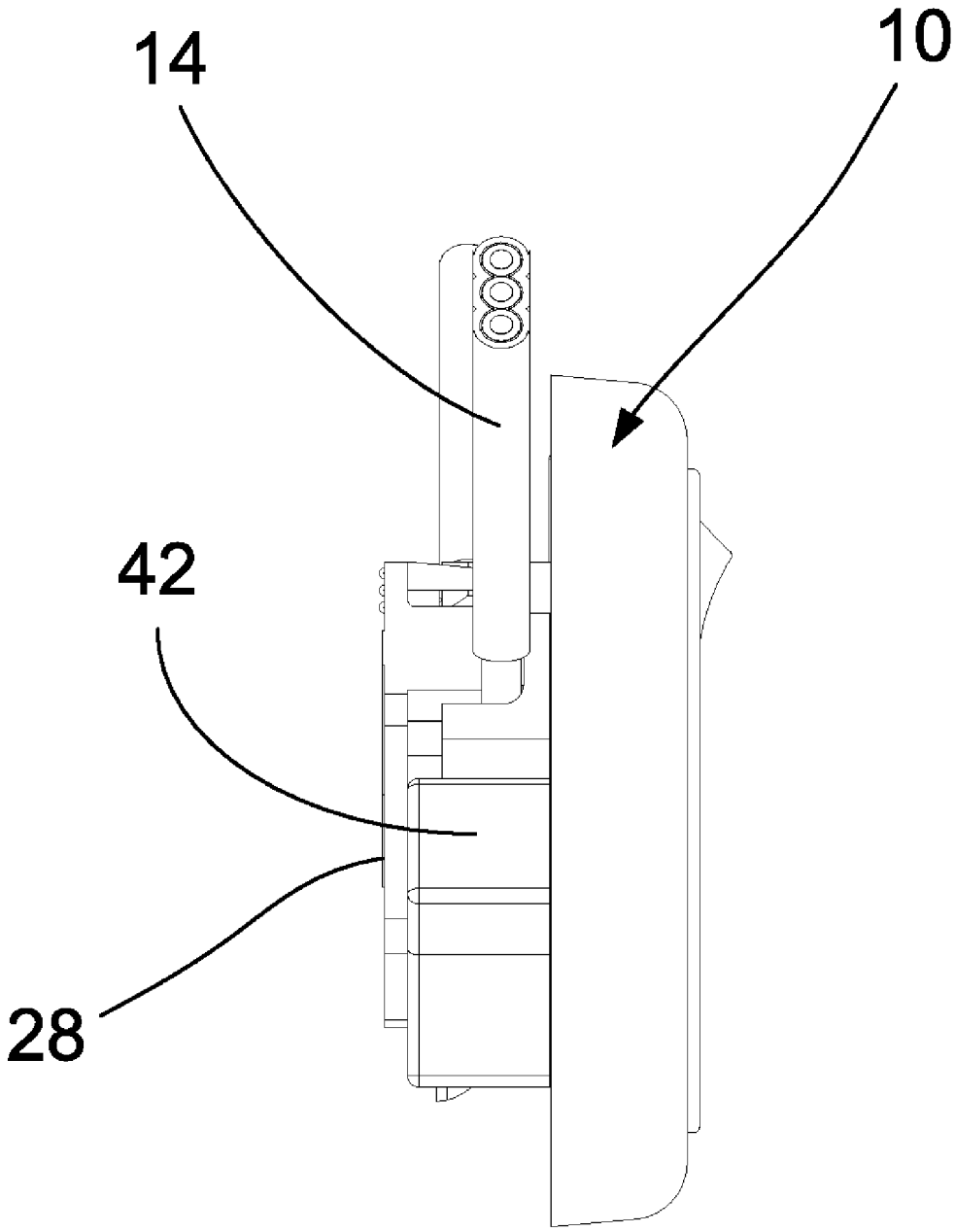
FIG. 11 is a diagrammatic illustration of a side view of the power outlet shown in FIG. 10.

As shown in FIG. 9, the connector 28 and the channel plate 42 may be latched in the closed position by resilient clips 54*a*, 54*b* coupled to the connector 28 which releasably grip corresponding clips 56*a*, 56*b* of the channel plate 42. The connector 28 and the channel plate 42 can otherwise be fastened together using any other suitable means.

Figure 6:
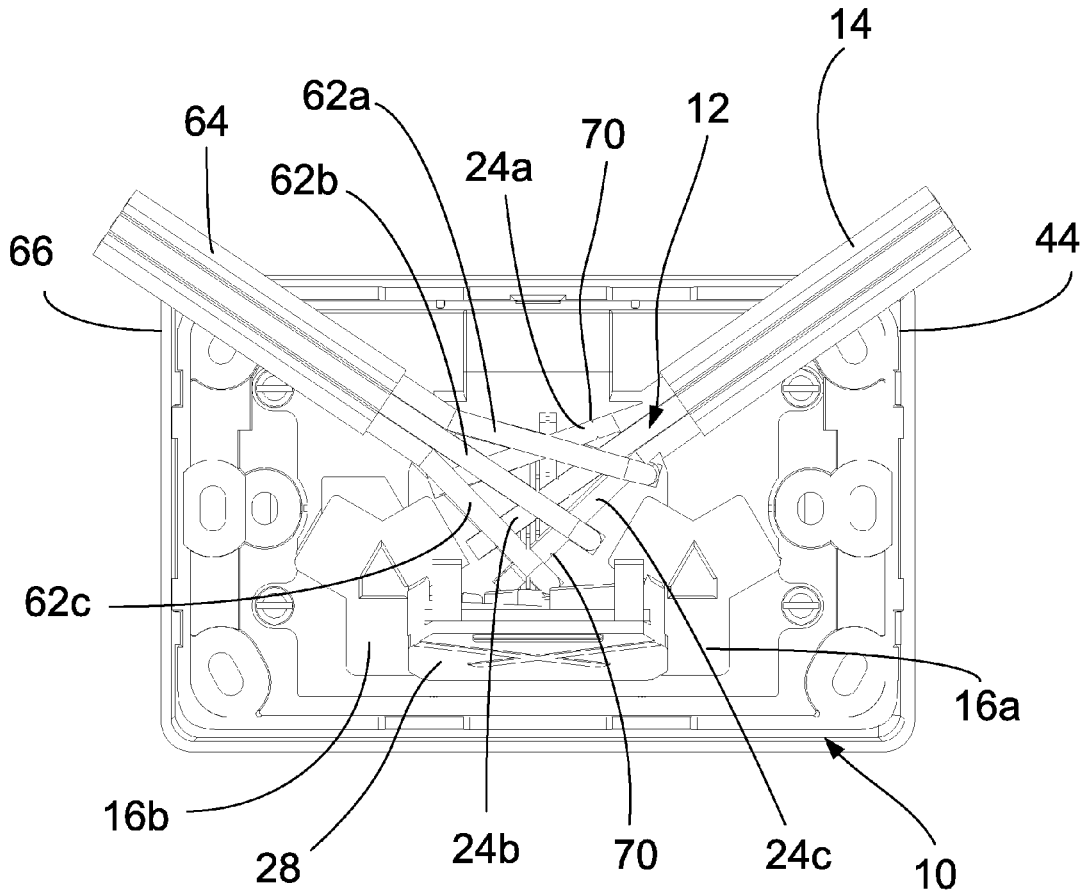
FIG. 6 is a diagrammatic illustration of a back view of the power outlet shown in FIG. 1 coupled to insulated conductors of power cables.

As particularly shown in FIGS. 5 and 6, the channel plate 42 includes secondary channels 58*a*, 58*b*, 58*c* shaped to at least partially receive, and seat therein, respective lengthwise sections 62*a*, 62*b*, 62*c* of the insulated conductors a second power cable 64. The channels 58*a*, 58*b*, 58*c* extend through respective insulation displacement contacts 26*a*, 26*b*, 26*c* and converge at a common point towards another corner 66 of the back side 40 of the outlet 10. Thus, the insulated conductors 62*a*, 62*b*, 62*c* fan out from the cable 64 when they are seated in corresponding channels 58*a*, 58*b*, 58*c*. The cable 64 thereby extends past the corner 66 of the back side 40 of the outlet 10 when the insulated conductors 62*a*, 62*b*, 62*c* are seated in their respective channels 58*a*, 58*b*, 58*c*. As particularly shown in FIG. 5, the channel plate 42 includes termination wells 68*a*, 68*b*, 68*c* located at terminal ends of the channels 58*a*, 58*b*, 58*c*. The termination wells 68*a*, 68*b*, 68*c* are shaped to receive and electrically isolate terminal ends of the insulated conductors 62*a*. 62*b*, 62*c*.

The conductors 62*a*, 62*b*, 62*c* overlie the conductors 24*a*, 24*b*, 24*c* when arranged in the above described manner. The insulation displacement contacts 26*a*, 26*b*, 26*c* are located at the intersections of corresponding primary and secondary channels 22*a*, 22*b*, 22*c*, 58*a*, 58*b*, 58*c*. Thus, each insulation displacement contact 26*a*, 26*b*, 26*c* is adapted to receive, and form electrical connections therewith, two insulated conductors.

The primary and secondary channels 22*a*, 22*b*, 22*c*, 58*a*, 58*b*, 58*c* include restraining flanges 70 to inhibit longitudinal movement of the insulated conductors in the channels.

As particularly shown in FIGS. 7 and 12, an inner side 50 of the connector 28 includes a plurality of projections 72*a*, 72*b*, 72*c* that extend along corresponding channels 58*a*, 58*b*, 58*c* of the channel plate 48 when the connector 28 is arranged in the closed position. When so arranged, the projections 72*a*, 72*b*, 72*c* are brought to positions where they are located over, and at least partially within, respective ones of the channels 58*a*, 58*b*, 58*c*. When the connector 28 is moved to the closed position shown in FIG. 10, the projections 72*a*, 72*b*, 72*c* are likewise located in respective ones of the channels 58*a*, 58*b*, 58*c*.

The first primary channel 22*a* preferably extends at an angle of substantially 145 degrees to a corresponding first secondary channel 58*a*. The second primary channel 22*b* extends at an angle of substantially 111 degrees to a corresponding second secondary channel 58*b*. A third primary channel 22*c* extends at an angle of substantially 91 degrees to a corresponding third secondary channel 58*c*.

The connector 28 can preferably be terminated (closed) using standard electrician's pliers. The insulated connector 28 can prevent accidental shock. The outlet preferably includes a stripping length guide. The connector 28 is adapted to over travel past the closed position to allow correct clip engagement.

While we have shown and described specific embodiments of the present invention, further modifications and improvements will occur to those skilled in the art. We desire it to be understood, therefore, that this invention is not limited to the particular forms shown and we intend in the append claims to cover all modifications that do not depart from the spirit and scope of this invention.

The invention claimed is:

1. A power outlet for effecting an electrical connection between an electric device and insulated conductors of an electric power cable, comprising:

(a) a socket having apertures including electrically conductive socket contacts seated therein for effecting electrical connection to corresponding electrically conductive contacts of a plug of the electric device;

(b) a plurality of primary channels shaped to at least partially receive, and seat therein, respective lengthwise sections of the insulated conductors of the power cable;

(c) a plurality of insulation displacement contacts for making separate electrical connections to said insulated conductors, when received in said primary channels, under relative movement between the insulation displacement contacts and the insulated conductors; and (d) a connector, relatively movable with respect to the primary channels, for effecting said relative movement, wherein the insulation displacement contacts are electrically coupled to respective ones of said socket contacts; and said primary channels extend transversely to a lengthwise direction of extent of the power outlet.

2. The power outlet claimed in claim 1, wherein longitudinal directions of extent of the primary channels converge at a common point.

3. The power outlet claimed in claim 1, wherein the insulation displacement contacts are arranged centrally on a side of the outlet.

4. The power outlet claimed in claim 3, wherein the insulation displacement contacts are arranged side by side.

5. The power outlet claimed in claim 4, wherein side to side directions of slots of the insulation displacement contacts are parallel.

6. The power outlet claimed in claim 5, wherein each slot of the insulation displacement contacts opens in a direction substantially 45 degrees to a direction of extent of its respective channel.

7. The power outlet claimed in claim 1, further comprising a hinge for effecting said relative movement as the connector rotates there about towards the primary channels.

8. The power outlet claimed in claim 7, wherein the connector is adapted to rotate about the hinge between an open position and a closed position.

9. The power outlet claimed in claim 8, wherein said relative movement is effected as the connector moves towards the closed position.

10. The power outlet claimed in claim 8, wherein the connector generally parallel to the primary channels when arranged in the closed position.

11. The power outlet claimed in claim 10, wherein the connector is adapted to rotate about the hinge past the closed position to force insulated conductors into the insulation displacement contacts.

12. The power outlet claimed in claim 1, further comprising a plurality of secondary channels shaped to at least partially receive, cable, wherein the insulation displacement contacts are located at intersections of the second channels and corresponding primary channels so as to electrically connect insulated conductors seated in the primary channel with corresponding insulated conductors seated in the secondary channels during said relative movement.

13. The power outlet claimed in claim 12, wherein the secondary channels extend transversely to a lengthwise direction of extent of the power outlet.

14. The power outlet claimed in claim 12, wherein longitudinal directions of extent of the secondary channels converge at another common point.

15. The power outlet claimed in claim 12, wherein a first channel of the primary channels extends at an angle of substantially 145 degrees to a corresponding first channel of the secondary channels.

16. The power outlet claimed in claim 12, wherein a second channel of the primary channels extends at an angle of substantially 111 degrees to a corresponding second channel of the secondary channels.

17. The power outlet claimed in claim 12, wherein a third channel of the primary channels extends at an angle of substantially 91 degrees to a corresponding third channel of the secondary channels.

18. The power outlet claimed in claim 1, wherein the primary channels include one or more strain relief ribs.

19. The power outlet claimed in claim 12, wherein the secondary channels include one or more strain relief ribs.

20. The power outlet claimed in claim 1, wherein the primary channels each include a include termination well for receiving, and electrically isolating, a terminal end of an insulated conductor.

21. The power outlet claimed in claim 12, wherein the secondary channels each include a include terminal well for receiving, and electrically isolating, a terminal end of an insulated conductor.

22. The power outlet claimed in claim 1, further comprising a cable stripping length guide.

23. The power outlet claimed in claim 1, wherein one or more of said insulation displacement contacts are electrically coupled to said corresponding socket contacts by bifurcated electrically conductive contacts.

24. The power outlet claimed in claim 1, further comprising another socket having apertures including electrically conductive socket contacts seated therein for effecting electrical connection to corresponding electrically conductive contacts of a plug of an electric device.

25. The power outlet claimed in claim 23, wherein the socket contacts of the socket are electrically coupled to corresponding socket contacts of said another socket.

* * * * *